US007818930B2

(12) United States Patent
Le Bot et al.

(10) Patent No.: US 7,818,930 B2
(45) Date of Patent: Oct. 26, 2010

(54) SYSTEM FOR FIXING A PANEL MADE OF BRITTLE MATERIAL

(75) Inventors: Pierre Le Bot, Lacroix Falgarde (FR); Jean-Clement Nugue, Lamorlaye (FR)

(73) Assignee: Saint-Gobain Glass France, Courbevoie (FR)

( * ) Notice: Subject to any disclaimer, the term of this patent is extended or adjusted under 35 U.S.C. 154(b) by 1014 days.

(21) Appl. No.: 10/516,321

(22) PCT Filed: Jun. 18, 2003

(86) PCT No.: PCT/FR03/01853

§ 371 (c)(1),
(2), (4) Date: Jul. 8, 2005

(87) PCT Pub. No.: WO04/001171

PCT Pub. Date: Dec. 31, 2003

(65) Prior Publication Data

US 2005/0284066 A1 Dec. 29, 2005

(30) Foreign Application Priority Data

Jun. 19, 2002 (FR) ..... 02 07540

(51) Int. Cl.
*E04B 2/88* (2006.01)

(52) U.S. Cl. ..... 52/235; 52/204.67; 52/506.05

(58) Field of Classification Search ..... 52/235, 52/506.05, 204.64, 204.66–204.68, 204.7, 52/204.71; 248/220.1, 480, 490, 488, 491; 40/782, 757, 758, 783, 792–795; 16/252
See application file for complete search history.

(56) References Cited

U.S. PATENT DOCUMENTS

| | | | | | |
|---|---|---|---|---|---|
| 222,279 | A | * | 12/1879 | Johnson | 40/700 |
| 412,953 | A | * | 10/1889 | Gale | 40/749 |
| 1,083,502 | A | * | 1/1914 | MacDowney | 52/204.57 |
| 1,454,335 | A | * | 5/1923 | Prendergast | 59/85 |
| 1,538,338 | A | * | 5/1925 | La Hodny | 248/488 |
| 1,789,740 | A | * | 1/1931 | Gelette | 248/488 |

(Continued)

FOREIGN PATENT DOCUMENTS

BE 1 009 254 1/1997

(Continued)

OTHER PUBLICATIONS

Machine translation of FR 1077193.*

*Primary Examiner*—Robert J Canfield
*Assistant Examiner*—Christine T Cajilig
(74) *Attorney, Agent, or Firm*—Oblon, Spivak, McClelland, Maier & Neustadt, L.L.P.

(57) ABSTRACT

A fixing system for fixing a panel of fragile material to a bearing structure, including at least one point fastener engaging with at least one first contact region produced in the panel. The point fastener includes a first anchoring part at a first contact region and a second anchoring part at a second contact region situated on the panel. The first and second anchoring parts are connected by at least one adjusting device configured to bring the first and second anchoring parts to bear against the first and second contact regions respectively and are situated in the plane of the panel.

22 Claims, 3 Drawing Sheets

U.S. PATENT DOCUMENTS

| | | | | | |
|---|---|---|---|---|---|
| 1,938,541 | A | * | 12/1933 | Oishei | 248/481 |
| 2,092,411 | A | * | 9/1937 | Anderson | 52/223.6 |
| 3,694,984 | A | * | 10/1972 | Schwartz | 52/204.593 |
| 3,936,968 | A | * | 2/1976 | Gilbert | 40/783 |
| 4,028,832 | A | * | 6/1977 | Wu | 40/741 |
| 4,282,668 | A | * | 8/1981 | Jolkovski | 40/790 |
| 4,475,325 | A | * | 10/1984 | Veldhoen | 52/235 |
| 4,629,152 | A | * | 12/1986 | Spilka | 248/488 |
| 4,991,328 | A | * | 2/1991 | Rousseau et al. | 40/780 |
| 5,787,662 | A | | 8/1998 | Danz | |

FOREIGN PATENT DOCUMENTS

| | | | |
|---|---|---|---|
| DE | 198 16 099 | | 10/1999 |
| FR | 1077193 | * | 11/1954 |
| FR | 1 376 444 | | 10/1964 |
| FR | 1 376 738 | | 10/1964 |
| FR | 2 368 600 | | 5/1978 |
| FR | 2 739 406 | | 4/1997 |

* cited by examiner

SYSTEM FOR FIXING A PANEL MADE OF BRITTLE MATERIAL

CROSS-REFERENCE TO RELATED DOCUMENTS

The present patent document is the U.S. counterpart of WO 04/001171, and in turn claims priority to French application number 02/07540 filed on Jun. 19, 2002, the entire contents of each of which are hereby incorporated herein by reference.

The present invention relates to the field of fixing means and relates more specifically to a system for fixing panels of fragile material to a bearing structure using point attachments.

Particularly in the field of the fixing of glazing to bearing structures of buildings, there are numerous point fixing systems in existence intended to preserve maximum visibility through the glazing, by point attachments that occupy only a very small surface area of the glazing. Thus, point fixing systems with fasteners that hold the glazing by clamping on both faces of the glass panel, sometimes on each side of a through-hole, have been proposed. Such systems are described in particular in documents FR-A-2 739 406 and DE-A-195 14 818.

These systems provide a solution tailored to the problem of fixing a panel in a plane roughly coplanar with the bearing structure but do not offer an optimum solution in terms of immobilizing the panel in the plane of the bearing structure. What happens is that the known fixing systems of the prior art are positioned in a direction roughly perpendicular to the plane of the panel, thereby generating an additional space between the bearing structure and the plane of the panel for their installation, this installation projecting from the plane of the panel introducing a moment that detracts from the life of the fixing.

All that leads to a considerable cost which carries the risk of restricting the use of these systems to prestige installations.

The object of the present invention is to propose a point fixing system that is simple but still satisfactory from the point of view of esthetic requirements and which lies roughly in the plane of the panel.

To this end, the subject of the invention is a fixing system for fixing a panel of fragile material to a bearing structure, comprising at least one point fastener engaging with at least one first contact region produced in the panel, which is characterized in that said point fastener comprises a first anchoring part at a first contact region and a second anchoring part at a second contact region, the first and second anchoring parts being, on the one hand, connected by at least one adjusting device designed to bring the first and second anchoring parts to bear against the first and second contact regions respectively and, on the other hand, situated in the plane of the panel.

By virtue of this fixing system, the forces resulting from the fixing of the panel to the bearing structure are directed in the plane of the panel and roughly in the continuation thereof, thus not introducing additional thickness between the panel and the bearing structure.

The invention is thus suited to the fixing of glass panels of all types: monolithic, laminated, or multiple glazing, with sheets of glass, possibly laminated, separated by air gaps or gaps filled with some other gas, the glass not necessarily being toughened or, as appropriate, having been toughened to a far more relaxed specification.

The presence of the adjusting device makes it possible to introduce into the plane of the panels compressive stresses which will oppose the mechanical forces, particularly of tension, when said panel is fixed to the bearing structure or to another panel.

In preferred embodiments of the invention, recourse may possibly be had to one and/or another of the following measures:

- the second contact region is situated on the panel,
- the second contact region is situated on the edge face of the panel,
- the second contact region is situated on the side of the panel,
- the second contact region is situated on the bearing structure,
- the first and/or the second contact region is produced within a blind orifice,
- the first and/or the second contact region is produced within an open orifice,
- the first and/or the second contact region is produced within a cut-out,
- the first and/or the second contact region is produced using a number of raised regions,
- the first and/or the second contact region is produced by pinching,
- the first and second contact regions are positioned on two respective adjacent sides of the panel,
- the first and second contact regions are positioned one on each side of an axis of symmetry of the panel,
- the fixing system comprises two point fasteners each positioned on each side of a mid-plane roughly parallel to the panel, this mid-plane also being roughly perpendicular to the first and second contact regions,
- the fixing system comprises a rigid interlayer positioned between one of the first and second contact regions and one of the first or second anchoring parts,
- the adjusting device comprises a tensioning device,
- the tensioning device comprises a screw-nut device,
- the adjusting device comprises a torque-limiting device,
- the interlayer comprises a rigid interlayer element and an adhesive material, the rigid interlayer element contributing to the dimensional stability of the layer by reacting the forces while the adhesive material allows an adhesive bond to be achieved,
- the interlayer element is made of a material with a Shore D hardness of the order of at least 70 to 75,
- the material of which the interlayer element is made is chosen from transparent materials such as polycarbonate or hard silicone which does not adversely affect the esthetics of the whole,
- the adhesive material in particular has a Shore A hardness of the order of 30 to 35 and is chosen from silicone adhesives commonly used with glass,
- the interlayer element is arranged along the axis of the mid-plane of the panel,
- one of the first or second contact regions is fitted with a ferrule, the latter having the point fasteners passing through it.

The fixing system according to the invention allows vertical or inclined panels to be fixed, particularly for screens or facings of straight facades, the point fasteners alone taking the weight of the glazing or the like.

The system makes it possible to take practically all the vertical component of the forces to which the panel is subjected.

Another subject of the invention is the application of a fixing system as described hereinabove to the production of a roof structure or facade made of panels of fragile material, particularly glass.

It also applies to the use of a fixing system as described hereinabove to the making of a connection between at least two panels, it being possible for these panels to move relative to one another, particularly in sliding or in pivoting.

The invention will be described in greater detail with reference to the attached drawings in which.

In the appended drawings, some elements may be depicted larger or smaller than they are in real life, in order to make the figures easier to understand.

Figure 1:
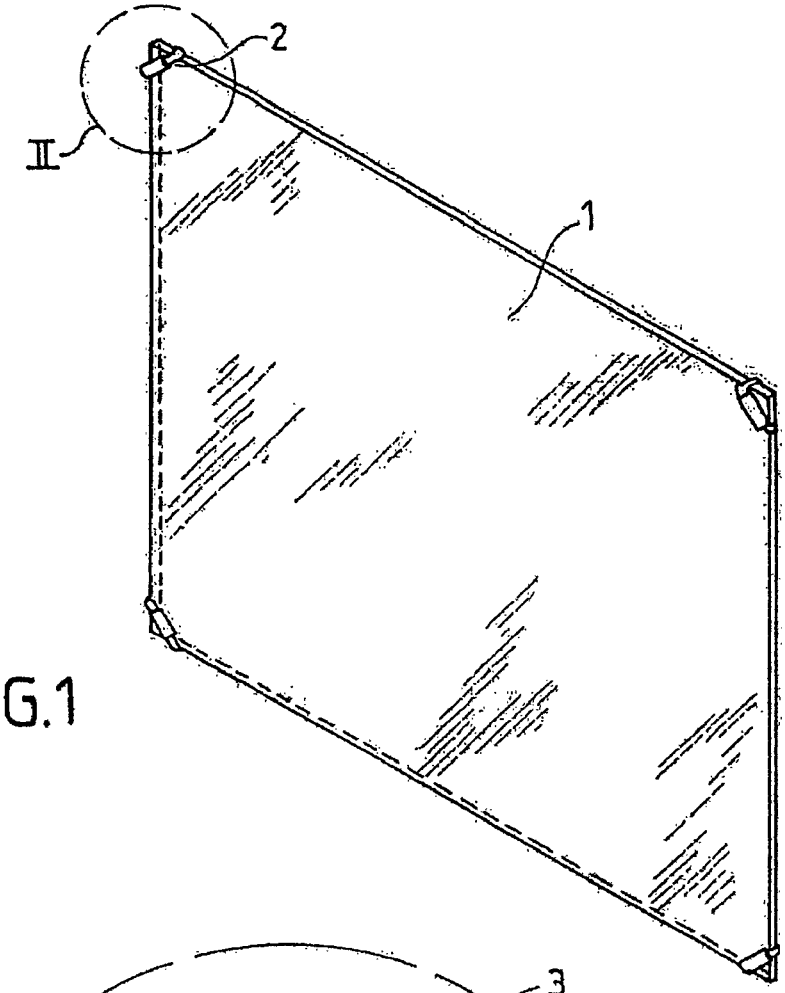
FIG. 1 depicts a perspective view of a screen suspended from a bearing structure.

FIG. 1 depicts a screen, more commonly known as a "diffusing screen" in this technical field, made up of at least one glass panel 1, this glass panel being intended to be suspended from a bearing structure using at least one fixing system 2 according to the invention.

In the example depicted in FIG. 1, there are four fixing systems 2 per panel 1, acting one in each corner of the panel. Of course, the number and location of the fixing systems on the panel can be altered to suit the architectural desires.

For very extensive glazed surfaces comprising a great many juxtaposed glass panels, two or more adjacent point fasteners may be fixed to the structure by a two-arm or multi-arm connecting piece.

Figure 2:
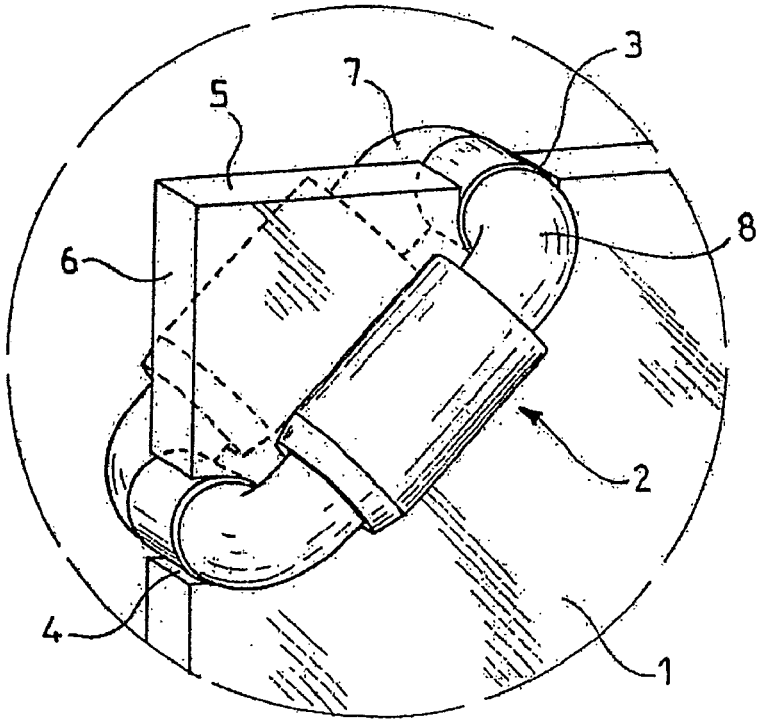
FIG. 2 depicts a perspective view of a detail of FIG. 1.

FIG. 2 shows a detail of the embodiment of the panel 1 of FIG. 1, at one of its corners.

The panel 1 is provided with a first contact region 3 and with a contact region 4 which are positioned roughly on each side of an axis of symmetry of said panel 1, in this instance along one of its diagonals. These first and second contact regions 3, 4 are situated at two adjacent edge faces 5, 6 respectively of the panel 1 and have an open part thus allowing at least one point fastener 7 to pass. As an alternative, these contact regions may be situated on one of the sides of the panel, within a blind or open orifice, or via cut-outs or raised regions (roughnesses, flutes, studs, etc.) or alternatively via a connection of the pinching type.

The fixing system 2 depicted in FIG. 2 comprises two point fasteners 7, 8 each positioned on either side of a mid-plane of said panel. This mid-plane is roughly parallel to the plane of the panel and perpendicular to the first and second contact regions 3, 4.

Each of the point attachments is in the form of a U-shaped clip and is preferably made of a metallic material, particularly of stainless steel.

Each of the clips (depicted in section in FIG. 3) has a central part 9, 10 and two lateral parts 11, 12, 13, 14. The central part 9, 10 of each clip bears on each of the first and second contact regions 3, 4 at first and second anchoring parts respectively, while each of the lateral parts 11, 12, 13, 14 of each of the clips positioned on one and the same side of the panel are connected together by adjusting devices 15, 16 designed to move the central parts 9, 10 of the clips closer together within the contact regions 3, 4.

Figure 3:
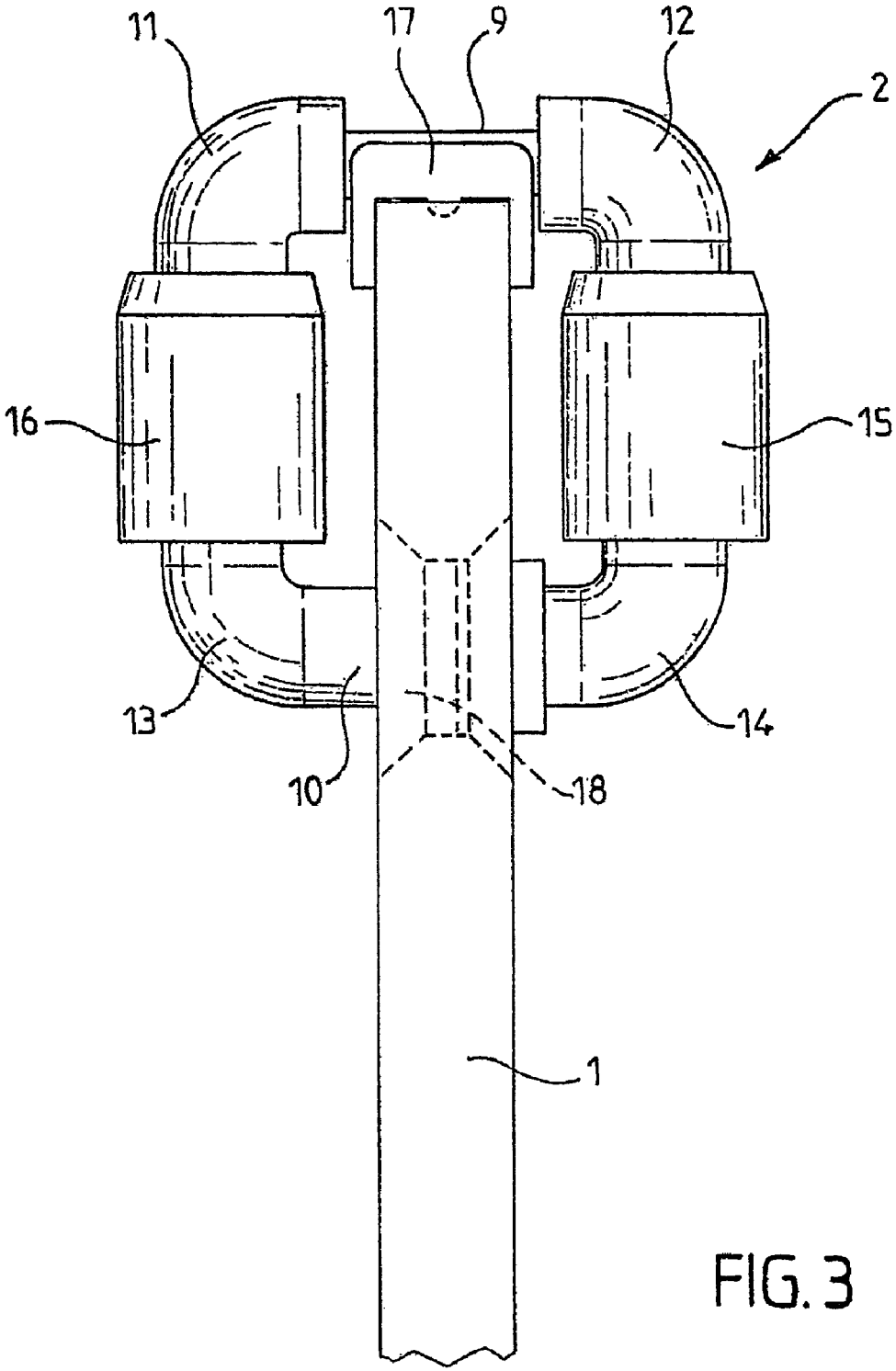
FIG. 3 depicts an alternative form of the invention, depicted in perspective.

In the exemplary embodiment depicted in FIG. 3, the adjusting device is a tensioning device consisting of a screw-nut system, the part acting as a nut consisting, for example, of a ring with a tapped thread on its internal wall, this ring being mounted to slide on a lateral part of the clip, the part acting as a nut for example consisting of a threaded end of the lateral part of the second clip positioned on the same side of the panel.

By moving the point fasteners closer together using the adjusting devices 15, 16 it is possible to introduce into the region of the panel opposite the anchoring parts compressive stresses which could oppose those generated as the panel is being attached to the bearing structure.

Of course, the material of which the point fasteners are made will be altered to suit the mass of the panel, the nature of the material of which the panel is made and the intensity of the induced stresses. It will thus be possible to choose plastics or composites.

Likewise, according to an alternative form not depicted in the figures, a torque-limiting devices, particularly one operating on friction for example, may be added to the adjusting devices 15, 16.

Figure 4:
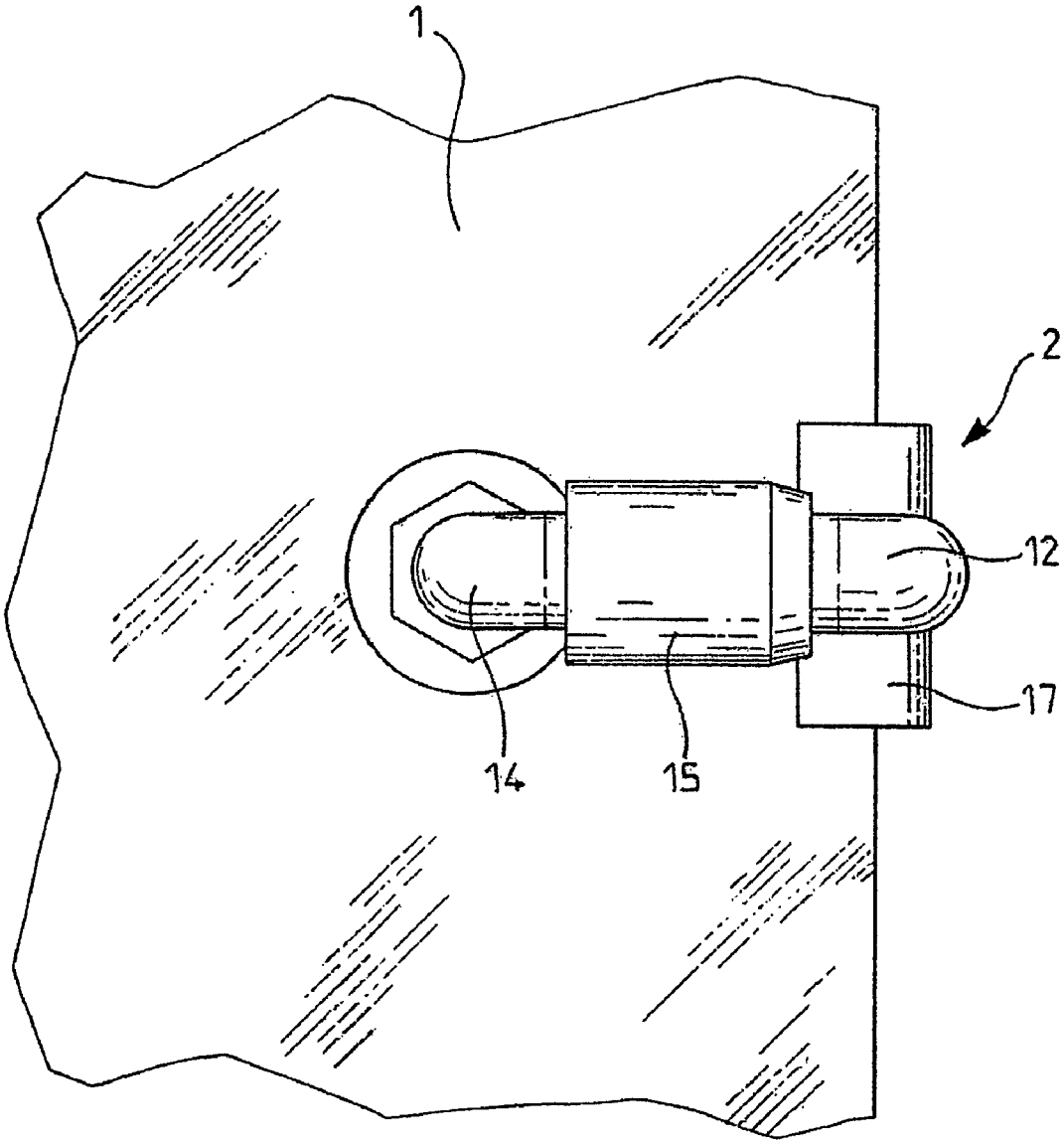
FIG. 4 is a side view of FIG. 3.

FIGS. 3 and 4 depict another alternative form of embodiment of the invention. This differs from the one depicted in FIG. 2 in that one of the contact regions (the first or the second) is not situated on the periphery of the panel but in a part set back from the edge.

Furthermore, in FIG. 4, it can be seen that the point fasteners of the fixing system 2 do not bear directly against the edge face of the panel in a contact region, but at an interlayer 17.

The interlayer 17 comprises an interlayer element arranged near the bearing region and possibly an adhesive material deposited on the interlayer element.

The interlayer element is a rigid sheet, preferably transparent, for example made of polycarbonate or hard silicone with a Shore D hardness of the order of at least 70 to 75.

The adhesive is advantageously also transparent, particularly based on a silicone or acrylic material that is UV-cross-linkable.

By virtue of the presence of the rigid interlayer element, the adhesive can be relatively flexible, with a hardness lower than that of the interlayer element. Thus, an adhesive material which, in a cured state, has a Shore A hardness of the order of 30 to 35, for example of the silicone type, makes it possible to achieve an effective adhesive joint between the interlayer element and the glass panel, while the interlayer element gives the interlayer 17 the required rigidity.

Once the adhesive material has cured, the interlayer 17 allows all the weight of the panel to be transmitted to the structure without the risk of crushing the layer over time by virtue of the rigid interlayer element.

In the alternative form of embodiment depicted in FIG. 3, the contact region set back from the periphery of the panel comprises a ferrule 18, made of a metallic material. This ferrule by bearing on the walls of the contact region mechanically strengthens the walls of the contact region and therefore allows the fixing system to bear higher induced forces.

As an alternative not depicted in the figures, this ferrule 18 is provided with an articulation to allow any relative movements to be transmitted when the panel is being fitted and/or under the effect of localized loads (the weight of snow cover) or thermal expansion of the panel.

In this embodiment, not depicted, the articulation consists of a ball or any other equivalent articulation system, preferably allowing an amplitude of movement of at least 5° angle in each direction.

The fixing system 2 according to the invention provides a good solution that does not require special fashioning of the glass panel, the contact regions being machined regions that can be produced easily.

By advantageously choosing transparent materials to make the interlayer and possibly the fixing system, the fixing solution obtained meets the esthetic requirements of maximum transparency often laid down by the architects.

The detailed description of the invention has just been given for the case of particular embodiments of screens, to which the invention is not restricted.

Finally, the panels to be fixed may be glazing, of the monolithic, laminated, hybrid, decorated type, but may also involve display panels or alternatively panels of natural fragile material such as stone, marble or synthetic panels.

By virtue of this fixing system, it is possible to connect together at least two panels or at least one panel and a bearing structure, it being possible for these panels to move relative to one another (pivoting, sliding) or alternatively it being possible to achieve opening frame/fixed frame functions.

The invention claimed is:

1. An assembly comprising:

a panel of fragile material having two faces and at least one edge surface connecting said faces, the at least one edge surface comprising a first contact region and a second contact region, wherein a portion of said panel is interposed between said first and second contact regions; and at least one point fastener along each face of the panel occupying a small area of the panel, each said at least one point fastener comprising a first anchoring part configured to engage said first contact region and a second anchoring part configured to engage said second contact region; and at least one rigid adjusting device configured to apply a force in a direction parallel to said faces and along a line connecting the first and second anchoring parts to draw the first and second anchoring parts toward one another, whereby the first and second anchoring parts bear against the interposed portion of the panel at the first and second contact regions, respectively, whereby the panel can be fixed to a bearing structure by way of the point fastener. other.

2. The assembly as claimed in claim 1, wherein the second contact region is situated on a side of the panel.

3. The assembly as claimed in claim 1 herein at least one of the first and the second contact regions is within a blind orifice.

4. The assembly as claimed in claim 1, wherein at least one of the first and the second contact regions is at an edge provided at an open orifice.

5. The assembly as claimed in claim 1, wherein at least one of the first and the second contact regions is at an edge provided at a cut-out.

6. The assembly as claimed in claim 1, wherein at least one of the first and the second contact regions is at an edge provided at a number of raised regions.

7. The assembly as claimed in claim 1, wherein at least one of the first and the second contact regions is produced by pinching.

8. The assembly as claimed in claim 1, wherein the first and second contact regions are positioned on two respective adjacent side edges of the panel.

9. The assembly as claimed in claim 8, wherein the first and second contact regions are positioned one on each side of an axis of symmetry of the panel.

10. The assembly as claimed in claim 1, wherein the fixing system comprises two of said point fasteners, each of said point fasteners positioned on a different side of said panel.

11. The assembly as claimed in claim 1, further comprising a rigid interlayer positioned between one of the first and second contact regions and one of the first or second anchoring parts.

12. The assembly as claimed in claim 1, wherein the adjusting device comprises a tensioning device.

13. The assembly as claimed in claim 12, wherein the tensioning device comprises a screw-nut device.

14. The assembly as claimed in claim 12, wherein the adjusting device comprises a torque-limiting device.

15. The assembly as claimed in claim 11, wherein the rigid interlayer comprises a rigid interlayer element and an adhesive material, the rigid interlayer element contributing to dimensional stability by reacting forces while the adhesive material allows an adhesive bond to be achieved.

16. The assembly as claimed in claim 15, wherein the interlayer element is made of a material with a Shore D hardness of the order of at least 70 to 75.

17. The assembly as claimed in claim 16, wherein the material of which the interlayer element is made is chosen from transparent materials of polycarbonate or hard silicone that do not adversely affect esthetics.

18. The assembly as claimed in claim 15, wherein the adhesive material has a Shore A hardness of the order of 30 to 35 and is chosen from silicone adhesives.

19. The assembly as claimed in claim 15, wherein the interlayer element is arranged along an axis of a mid-plane of the panel.

20. The assembly as claimed in claim 1, wherein one of the first or second contact regions is fitted with a ferrule, having the point fasteners passing through it.

21. The assembly as claimed in claim 1, wherein the material is a transparent glazing.

22. The assembly as claimed in claim 1, wherein the material is glass.

* * * * *